US009543644B2

(12) United States Patent
Wu et al.

(10) Patent No.: US 9,543,644 B2
(45) Date of Patent: Jan. 10, 2017

(54) METHOD AND AN APPARATUS FOR DECOUPLING MULTIPLE ANTENNAS IN A COMPACT ANTENNA ARRAY

(71) Applicant: The Chinese University of Hong Kong, Hong Kong (CN)

(72) Inventors: Ke-Li Wu, Hong Kong (CN); Luyu Zhao, Xi'an (CN); Kewei Qian, Chengdu (CN); Dacheng Wei, Guang Zhou (CN)

(73) Assignee: The Chinese University of Hong Kong, Hong Kong (CN)

( * ) Notice: Subject to any disclaimer, the term of this patent is extended or adjusted under 35 U.S.C. 154(b) by 205 days.

(21) Appl. No.: 14/321,483

(22) Filed: Jul. 1, 2014

(65) Prior Publication Data

US 2016/0006119 A1 Jan. 7, 2016

(51) Int. Cl.
*H01Q 1/50* (2006.01)
*H01Q 1/52* (2006.01)

(52) U.S. Cl.
CPC ..... *H01Q 1/523* (2013.01)

(58) Field of Classification Search
CPC ..... H01Q 1/521; H01Q 1/523; H01Q 1/525; H01Q 1/50; H01Q 1/52
USPC ..... 343/841, 850, 851, 852, 853, 860
See application file for complete search history.

(56) References Cited

U.S. PATENT DOCUMENTS

2010/0156745 A1* 6/2010 Andrenko ..... H01Q 1/38 343/848
2010/0225543 A1* 9/2010 Kakitsu ..... H04B 1/0064 343/702
2013/0314294 A1* 11/2013 Hsieh ..... H01Q 5/335 343/852
2014/0118214 A1* 5/2014 Tanaka ..... H01Q 5/335 343/852

(Continued)

FOREIGN PATENT DOCUMENTS

GB 2320816 * 8/1996

OTHER PUBLICATIONS

A Broadband Coupled Resonator Decoupling Network for a Three-element Compact Array, Wu et al.*

(Continued)

*Primary Examiner* — Dameon E Levi
*Assistant Examiner* — Awat Salih
(74) *Attorney, Agent, or Firm* — Seed IP Law Group LLP

(57) ABSTRACT

Disclosed is an apparatus for decoupling two antennas in an antenna array, in which the two antennas transmit and receive signals via a first input/output port and a second input/output port of the apparatus. The device may comprise a first adjusting device connected between a first antenna of the two antennas and the first input/output port, a second adjusting device connected between a second antenna of the two antennas and the second input/output port, and one or more decoupling networks connected between the first input/output port and the second input/output port. The first adjusting device and the second adjusting device are con- (Continued)

figured to have admittance adjustable to compensate an admittance of the decoupling networks such that an isolation coefficient between the two input/output ports approaches zero as well as reflection coefficients of each input/output port are minimized.

15 Claims, 9 Drawing Sheets

(56) References Cited

U.S. PATENT DOCUMENTS

| | | | | |
|---|---|---|---|---|
| 2014/0152523 | A1* | 6/2014 | Wu | H01Q 1/523 343/841 |
| 2014/0159986 | A1* | 6/2014 | De Luis | H01Q 1/50 343/852 |
| 2014/0320372 | A1* | 10/2014 | Wu | H01Q 21/28 343/853 |
| 2015/0255863 | A1* | 9/2015 | Yoshida | H01Q 21/28 343/860 |
| 2015/0255865 | A1* | 9/2015 | Nishimoto | H01Q 1/521 343/853 |
| 2015/0288075 | A1* | 10/2015 | Milroy | H01Q 21/0006 343/852 |

OTHER PUBLICATIONS

A Decoupling Technique for Increasing the port Isolation Between Two Strongly Coupled Antenna, Chen et al.*

A Coupled Resonator Decoupling Network for Two Element Compact Antenna Arrays in Mobile Terminals, Zhao et al.*

Chen et al., "A Decoupling Technique for Increasing the Port Isolation Between Two Strongly Coupled Antennas," *IEEE Transactions on Antennas and Propagation* 56(12):3650-3658 (Dec. 2008).

Chiu et al., "Reduction of Mutual Coupling Between Closely-Packed Antenna Elements," *IEEE Transactions on Antennas and Propagation* 55(6):1732-1738 (Jun. 2007).

Chung et al., "High Isolation Dual-Polarized Patch Antenna Using Integrated Defected Ground Structure," *IEEE Microwave and Wireless Components Letters* 14(1):4-6 (Jan. 2004).

Coetzee et al., "Port Decoupling for Small Arrays by Means of an Eigenmode Feed Network," *IEEE Transactions on Antennas and Propagation* 56(6):1587-1593 (Jun. 2008).

Diallo et al., "Study and Reduction of the Mutual Coupling Between Two Mobile Phone PIFAs Operating in the DCS1800 and UMTS Bands," *IEEE Transactions on Antennas and Propagation* 54(11):3063-3074 (Nov. 2006).

Diallo et al , "Enhanced two-antenna structures for universal mobile telecommunications system diversity terminals," *IET Microw. Antennas Propag*. 2(1):93-101 (2008).

Hong "Microstrip Filters for RF/Microwave Applications, 2nd Edition," Wiley ISBN: 978-0-470-40877-3 (Jan. 2011).

Hu et al., "Interference Avoidance for In-Device Coexistence in 3GPP LTE-Advanced: Challenges and Solutions," *IEEE Communications Magazine* (8 pages) (Nov. 2012).

Jensen et al., "A Review of Antennas and Propagation for MIMO Wireless Communications," *IEEE Transactions on Antennas and Propagation* 52(11):2810-2824 (Nov. 2004).

Khatri et al., "Integrated RF Interference Suppression Filter Design Using Bond-Wire Inductors," *IEEE Transactions on Microwave Theory and Techniques* 56(5):1024-1034 (May 2008).

Lau et al., "Simple and Efficient Decoupling of Compact Arrays With Parasitic Scatterers," *IEEE Transactions on Antennas and Propagation* 60(2):464-472 (Feb. 2012).

Li et al., "Characteristic Mode Based Tradeoff Analysis of Antenna-Chassis Interactions for Multiple Antenna Terminals," *IEEE Transactions on Antennas and Propagation* 60(2):490-502 (Feb. 2012).

Payandehjoo et al., "Employing EBG Structures in Multiantenna Systems for Improving Isolation and Diversity Gain," *IEEE Antennas and Wireless Propagation Letters* 8:1162-1165 (2009).

Raghavan et al., "Analysis and Design of an Interference Canceller for Collocated Radios," *IEEE Transactions on Microwave Theory and Techniques* 53(11):3498-3508 (Nov. 2005).

Rambabu et al., "Design of Multiple-Stopband Filters for Interference Suppression in UWB Applications," *IEEE Transactions on Microwave Theory and Techniques* 54(8):3333-3338 (Aug. 2006).

Salehi et al., "Elimination of Scan Blindness in Microstrip Scanning Array Antennas Using Defected Ground Structure," *Proceedings of the 37th European Microwave Conference*, Munich Germany (3 pages) (Oct. 2007).

Shaker et al., "*Q*-Bandwidth Relations for the Design of Coupled Multi-Element Antennas," IEEE (4 pages) (2009).

Su et al., "Printed MIMO-Antenna System Using Neutralization-Line Technique for Wireless USB-Dongle Applications," *IEEE Transactions on Antennas and Propagation* 60(2):456-463 (Feb. 2012).

Volmer et al., "An Eigen-Analysis of Compact Antenna Arrays and Its Application to Port Decoupling," *IEEE Transactions on Antennas and Propagation* 56(2):360-370 (Feb. 2008).

Weber et al., "Miniaturized Antenna Arrays Using Decoupling Networks With Realistic Elements," *IEEE Transactions on Microwave Theory and Techniques* 54(6):2733-2740 (Jun. 2006).

Yang et al., "Microstrip Antennas Integrated With Electromagnetic Band-Gap (EBG) Structures: A Low Mutual Coupling Design for Array Applications," *IEEE Transactions on Antennas and Propagation* 51(10):2936-2946 (Oct. 2003).

Yang et al., "A Novel Compact Electromagnetic-Bandgap (EBG) Structure and Its Applications for Microwave Circuits," *IEEE Transactions on Microwave Theory and Techniques* 53(1):183-190 (Jan. 2005).

Yeung et al., "Mode-Based Beamforming Arrays for Miniaturized Platforms," *IEEE Transactions on Microwave Theory and Techniques* 57(1):45-52 (Jan. 2009).

Zhao et al., "A Novel Second-order Decoupling Network for Two-element Compact Antenna Arrays," *Proceedings of APMC 2012*, Kaohsiung, Taiwan (3 pages) (Dec. 4-7, 2012).

Zhao et al., "A Broadband Coupled Resonator Decoupling Network for a Three-element Compact Array," *IEEE* (3 pages) (2013).

Zhao et al., "A Coupled Resonator Decoupling Network for Two-Element Compact Antenna Arrays in Mobile Terminals," *IEEE Transactions on Antennas and Propagation* 62(5):2767-2776 (May 2014).

* cited by examiner

METHOD AND AN APPARATUS FOR DECOUPLING MULTIPLE ANTENNAS IN A COMPACT ANTENNA ARRAY

TECHNICAL FIELD

The present application relates to an antenna decoupling technology, in particular, to an apparatus and a method for decoupling multiple antennas in a compact antenna array.

BACKGROUND

To satisfy the fast growing demands from mobile internet market for higher data rate on wireless communication systems, many advanced technologies for increasing the data throughput have been put into use. Among them, Multiple Input Multiple Output (MIMO) data accessing scheme, a proven technology to effectively use the multi path environment, has been becoming a compulsory option in today's wireless communication systems both in base stations and mobile terminals.

Due to an inevitable strong electromagnetic wave mutual coupling between closely spaced antennas in a MIMO wireless terminal, such as a 4G LTE smart phone, the mutual coupling and spatial correlation between antennas are severely high, which lowers the channel capacity gain due to a strong signal correlation. Therefore, how to reduce the unwanted mutual couplings of coupled antennas is a very important issue.

U.S. Ser. No. 13/691,227 by Wu et al. proposed a new technique named Coupled Resonator Decoupling Network (CRDN) for decoupling two coupled antennas. The basic principle underlying is to design a second or higher order coupled resonator network that is connected to the two coupled antennas in parallel and is with its mutual admittance opposite to that of the two coupled antennas such that the unwanted mutual coupling of two antennas can be canceled in a relatively wide frequency band.

However, to apply the new technology in a mobile terminal, a small form factor integrated decoupling apparatus that is independent to the form factors of the antennas is highly desirable. In addition, the circuitry of using the integrated CRDN is also critical in applying the unique technology.

SUMMARY

The present application proposes an apparatus for decoupling two antennas in a compact antenna array and a method for decoupling two antennas in a compact antenna array.

According to an embodiment of the present application, disclosed is an apparatus for decoupling two antennas in an antenna array, in which the two antennas transmit and receive signals via a first input/output port and a second input/output port of the apparatus. The device may comprise a first adjusting device connected between a first antenna of the two antennas and the first input/output port, a second adjusting device connected between a second antenna of the two antennas and the second input/output port, and one or more decoupling networks connected between the first input/output port and the second input/output port. The first adjusting device and the second adjusting device are configured to have admittance adjustable to compensate an admittance of the decoupling networks such that an isolation coefficient between the two input/output ports approaches zero and as well as reflection coefficients of each input/output port are minimized.

According to another embodiment of the present application, disclosed is an apparatus for decoupling a plurality of antennas in an antenna array, in which the plurality of antennas transmit and receive signals via respective one of a plurality of input/output ports. The device may comprise a plurality of adjusting devices, each of which connected between a respective antenna of the plurality of antennas and a respective one input/output port of the plurality of input/output ports, and one or more decoupling networks connected between the respective input/output ports of the plurality of input/output ports. The plurality of adjusting devices are configured to have an admittance adjustable to compensate an admittance of the decoupling networks such that an isolation coefficient between the input/output ports approach zero as well as reflection coefficients of each input/output port are minimized.

According to a further embodiment of the present application, disclosed is a method for decoupling two antennas in a antenna array, in which the two antennas transmit and receive signals via a first input/output port and a second input/output port. The method may comprise: inserting a first adjusting device between a first antenna of the two antennas and the first input/output port; inserting a second adjusting device between a second antenna of the two antennas and the second input/output port; connecting one or more decoupling networks between the first input/output port and the second input/output port; and adjusting an admittance of each of the first and the second adjusting devices to compensate an admittance of the decoupling networks such that an isolation coefficient between the two input/output ports approach zero as well as reflection coefficients of each input/output port are minimized.

BRIEF DESCRIPTION OF THE DRAWING

Exemplary non-limiting embodiments of the invention are described below with reference to the attached figures. The drawings are illustrative and generally not to an exact scale.

FIG. 6(*b*) is a schematic circuitry diagram illustrating a decoupling scheme for two antennas operating in the different frequency bands consistent with an embodiment of the present application.

FIG. 9(*b*) shows simulated and measured mutual coupling coefficient of the coupled and decoupled antennas arrays in the testing array of FIG. 9(*a*).

FIG. 9(*c*) shows simulated and measured reflection coefficient of the coupled and decoupled antennas arrays in the testing array of FIG. 9(*a*).

FIG. 10(*b*) shows simulated and measured reflection coefficient of the coupled and decoupled antennas arrays in the testing array of FIG. 10(*a*).

FIG. 10(*c*) shows simulated and measured isolation coefficient of the coupled and decoupled antennas arrays in the testing array of FIG. 10(*a*).

FIG. 10(*d*) shows efficiency of the testing array of FIG. 10(*a*) before and after decoupling by the apparatus according to the present application.

DETAILED DESCRIPTION

References will now be made in detail to exemplary embodiments, examples of which are illustrated in the accompanying drawings. When appropriate, the same reference numbers are used throughout the drawings to refer to the same or like parts.

Figure 1:
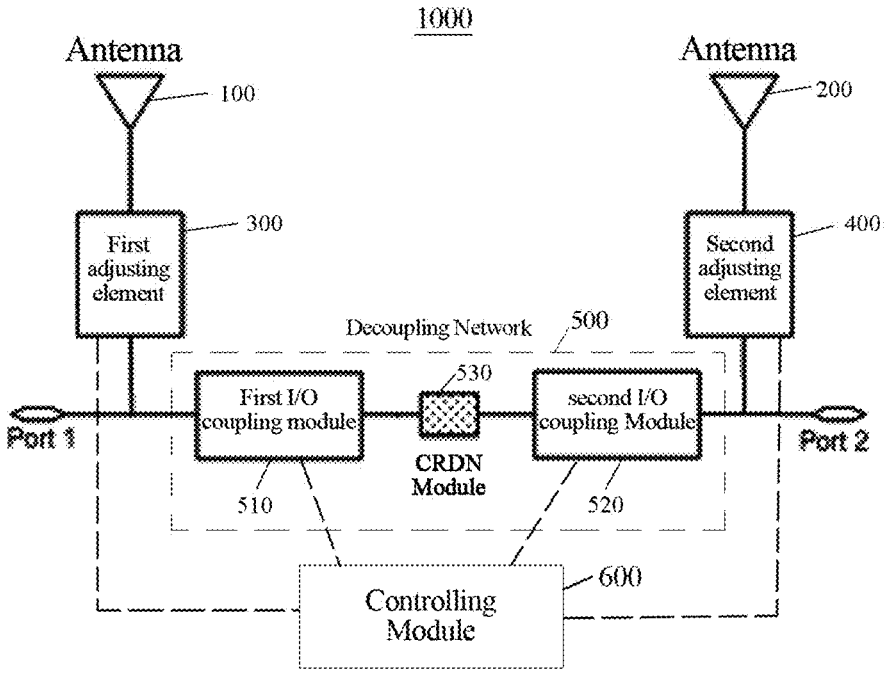
FIG. 1 is a schematic diagram illustrating an apparatus for decoupling two antennas in a compact antenna array consistent with an embodiment of the present application.

FIG. 1 is a schematic configuration of an apparatus 1000 for decoupling two antennas in an antenna array consistent with an embodiment of the present application. As known, a multi-antenna array comprises a plurality of closely disposed antennas. Hereinafter, a two-antenna array comprising two closely disposed antennas will be taken as an example to explain the application. It will be understood that, for an antenna array comprising more than two antennas, the configuration discussed below could be used for each two of the antennas. It will also be understood that, for an antenna array comprising more than two antennas, an alternative method is to design a multi-port decoupling network. Both of these two methods equivalently generate a second path of controllable mutual coupling to cancel out the existing antenna to antenna mutual coupling in a broadband sense.

As shown in FIG. 1, the two-antenna array comprises two closely disposed antennas 100, 200. According to the present application, the antennas 100, 200 may be identical or different antennas used for identical or different wireless services, such as 2G(GSM), 3G(UMTS), 4G(LTE), Wi-Fi, GPS and Bluetooth. In an embodiment, one end of the antenna 100 is connected to an input/output port 1 to transmit/receive data to/from the apparatus such as a mobile terminal in which the antenna array is installed. One end of the antenna 200 is connected to an input/output port 2 to transmit/receive data to/from the apparatus in which the antenna array is installed.

The apparatus 1000 may comprise a first adjusting device 300 and a second adjusting device 400. As shown, the first adjusting device 300 is connected between the first antenna 100 and the first input/output port 1, and the second adjusting device 400 is connected between the second antenna 200 and the second input/output port 2. According to an embodiment, the first adjusting device 300 and the second adjusting device 400 may be made of distributed element circuits, such as a transmission line or stepped impedance resonators circuits. Alternatively, the first adjusting device 300 and the second adjusting device 400 may be made of any form of lumped element circuits, such as a single inductor, a single capacitor, an LC 'π' network, an LC 'L' network or combination of them.

As shown in FIG. 1, the apparatus 1000 may further comprise a decoupling network 500. The decoupling network 500 may be connected between the first input/output port 1 and the second input/output port 2.

In an embodiment, the first adjusting device 300 and the second adjusting device 400 may be configured to have admittance adjustable to compensate an admittance of the decoupling network 500 such that an isolation coefficient between the two input/output ports approaches zero. According to the embodiment, the first adjusting device 300 and the second adjusting device 400 are configured to have an electrical length and characteristic impedance, both of which are adjustable to compensate the admittance of the decoupling network 500.

Referring to FIG. 1 again, each of the decoupling network 500 may comprise a first I/O coupling module 510, a second I/O coupling module 520 and a Coupled Resonator Decoupling Network (CRDN) module 530. The first I/O coupling module 510 is connected between the first input/output port 1 and the CRDN module 530, and the second I/O coupling module 520 is connected between the second input/output port 2 and the CRDN module 530. Thus, the first I/O coupling module 510, the second I/O coupling module 520 and the CRDN module 530 are connected with each other in series.

The CRDN module 530 may be implemented by using different passive integration technologies, including LTCC (Low Temperature Co-fired Ceramic) and multi-layered PCB. An illustrative example of a CRDN module 530 in the form of a LTCC will be given hereinafter.

Figure 2:
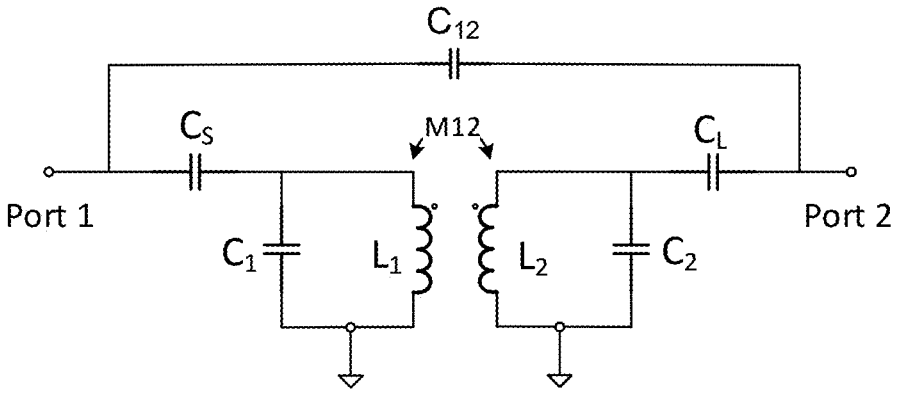
FIG. 2 is a schematic circuit diagram of an illustrative example CRDN module consistent with an embodiment of the present application.

A schematic circuit diagram of the illustrative example LTCC CRDN module 530 is shown in FIG. 2. A first resonant loop (L1, C1) in FIG. 2 is illustratively composed of a capacitor C1 and an inductor L1, and a second resonant loop (L2, C2) in FIG. 2 is illustratively composed of a capacitor C2 and an inductor L2. It is noted that the resonant loops may also be composed in other forms. According to the present application, the specific values of inductors and/or capacitors are unimportant, as long as the resonant frequency of the resonant loop is appropriate with respect to the coupled antennas and that the desired coupling coefficients are obtained.

The isolation coefficient between the two ports 1 and 2 is diminished by setting a coupling coefficient between the first resonant loop (L1, C1) and the second resonant loop (L2, C2) based on a constraint that the mutual admittance in the whole network composed of the two antennas, the first adjusting device and the second adjusting device, and the decoupling network approaches zero, whiles the self-admittances approach to the characteristic admittance of ports 1 and 2, respectively.

Figure 3:
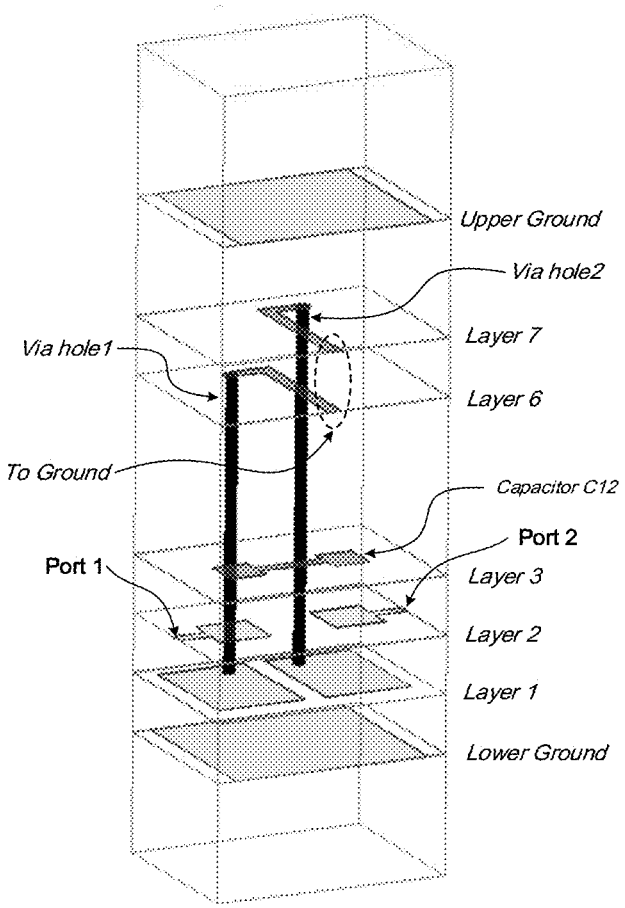
FIG. 3 is a physical layout of an LTCC realization of the illustrative example CRDN module consistent with an embodiment of the present application.

According to another embodiment, the CRDN module 530 may be implemented by using lumped elements or distributed elements or mixture of both as long as desired isolation coefficient is obtained. FIG. 3 shows a physical layout of an LTCC realization, in which the realization of each of the circuit elements in FIG. 2 is marked.

In an embodiment, the first I/O coupling module 510 and the second I/O coupling module 520 are configured to have adjustable electrical parameters such that the decoupling network 500 has an adjustable working frequency and adjustable decoupling level.

In an embodiment, the first I/O coupling module 510 and the second I/O coupling module 520 may be made of distributed element circuits, such as a transmission line or stepped impedance resonators circuits. Alternatively, the first I/O coupling module 510 and the second I/O coupling module 520 may be made of any form of lumped element circuits, such as a single inductor, a single capacitor, an LC 'π' network, an LC 'L' network or combination of them.

According to an embodiment, the apparatus 1000 may further comprise a controlling module 600 (shown in FIG. 1). The controlling module 600 may be coupled with the first adjusting device 300 and the second adjusting device 400, respectively. In addition, the controlling module 600 may further be coupled with the first I/O coupling module 510 and the second I/O coupling module 520, respectively. The controlling module 600 may be configured to control the adjustment of the first adjusting device 300 and the second adjusting device 400, and the adjustment of the first I/O coupling module 510 and the second I/O coupling module 520 so as to shift their working frequency bands, respectively.

Figure 4:
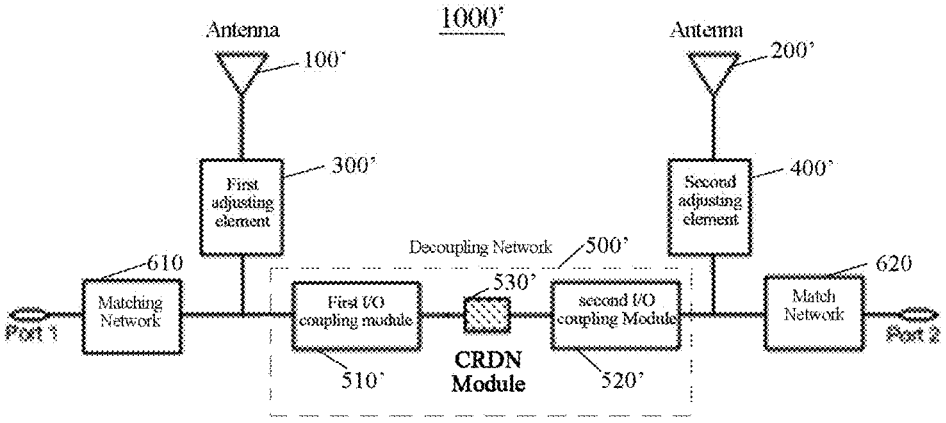
FIG. 4 is a schematic diagram illustrating an apparatus for decoupling two antennas in a compact antenna array consistent with another embodiment of the present application.

FIG. 4 is a schematic diagram illustrating an apparatus 1000' for decoupling two antennas 100' and 200' in a compact antenna array consistent with another embodiment of the present application. Similar to the apparatus 1000 illustrated in FIG. 1, the apparatus 1000' comprises a first adjusting device 300', a second adjusting device 400', a decoupling network 500'. The decoupling network 500' may comprise a first I/O coupling module 510', a second I/O coupling module 520' and a CRDN module 530'. The function and connecting relation of the above-mentioned elements in apparatus 1000' are similar to that in the apparatus 1000, and thus the detailed description will be omitted here. The difference between the apparatus 1000' and 1000 will be described in detail hereafter.

As shown in FIG. 4, the apparatus 1000' further comprises a first matching network 610 and a second matching network 620. The first matching network 610 is located at the port 1 of the apparatus 1000', and the second matching network 620 is added at the other port 2 of the apparatus 1000'. The matching networks 610 and 620 may be implemented by lumped LC elements or transmission line stubs to further broaden the matching bandwidth.

Figure 5:
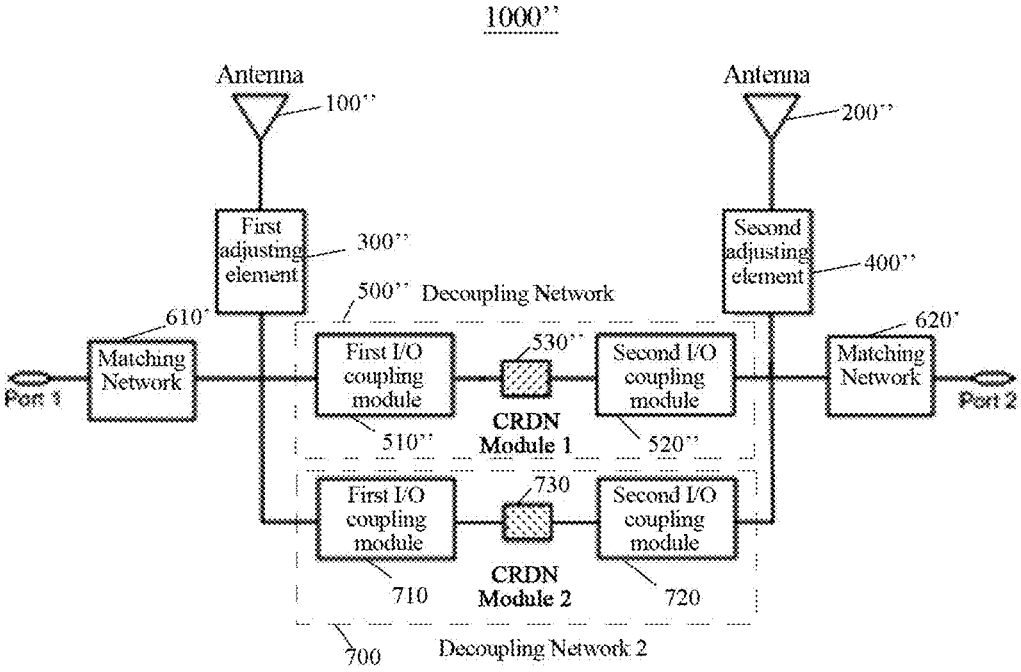
FIG. 5 is a schematic diagram illustrating an apparatus for decoupling two antennas in a compact antenna array consistent with a further embodiment of the present application.

FIG. 5 is a schematic diagram illustrating an apparatus 1000" for decoupling two antennas in a compact antenna array consistent with a further embodiment of the present application. Similar to the apparatus 1000 illustrated in FIG. 1 and the apparatus 1000' illustrated in FIG. 4, the apparatus 1000" comprises a first adjusting device 300", a second adjusting device 400", a decoupling network 500". The decoupling network 500" may comprise a first I/O coupling module 510", a second I/O coupling module 520" and a CRDN module 530". Similar to the apparatus 1000' illustrated in FIG. 4, the apparatus 1000" further comprises a first matching network 610' and a second matching network 620'. The function and connecting relation of the above-mentioned elements in the apparatus 1000" are similar to that in the apparatus 1000', and thus the detailed description will be omitted here. The difference between the apparatus 1000" and 1000' will be described in detail hereafter As shown in FIG. 5, the apparatus 1000" further comprises a second decoupling network 700. The second decoupling network 700 may comprise a first I/O coupling module 710, a second I/O coupling module 720 and a CRDN module 730. The first I/O coupling module 710, the second I/O coupling module 720 and the CRDN module 730 are connected with each other in series. According to an embodiment, the CRDN module 730 is configured to have at least one resonator configured to enhance the overall isolation. The first I/O coupling module 710 and the second I/O coupling module 720 are configured to have adjustable electrical parameters such that the decoupling networks 700 have an adjustable working frequency and an adjustable decoupling level.

According to this embodiment, the decoupling networks 500" and 700 are connected in parallel and each of the decoupling networks 500" and 700 may work in different frequency bands such that decoupling of the antennas 100" and 200" at different frequency bands are achievable.

According to the present application, the two antennas 100, 100', 100" and 200, 200', 200" may work in the same or different frequency bands. In the case of two antennas working in the same band, the two resonant loops may also be identical with each other. Otherwise, the two resonant loops may be in different resonant frequency from one another. Some illustrative prototype examples are shown in FIGS. 6(*a*)-7.

Figure 6A:
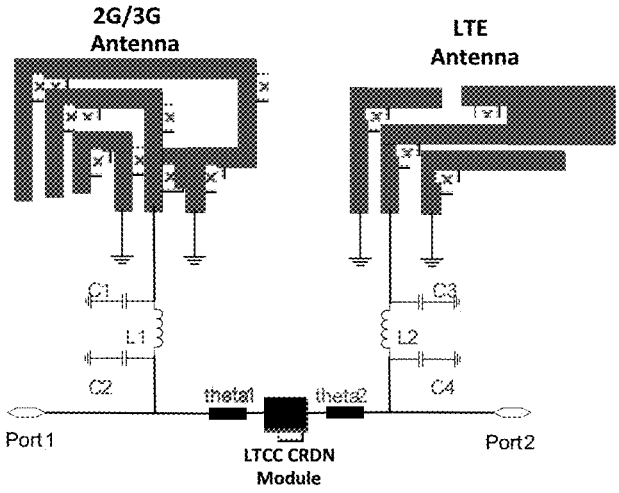
FIG. 6(*a*) is a schematic circuitry diagram illustrating a decoupling scheme for two antennas operating in the same frequency band consistent with an embodiment of the present application.
Figure 6B:
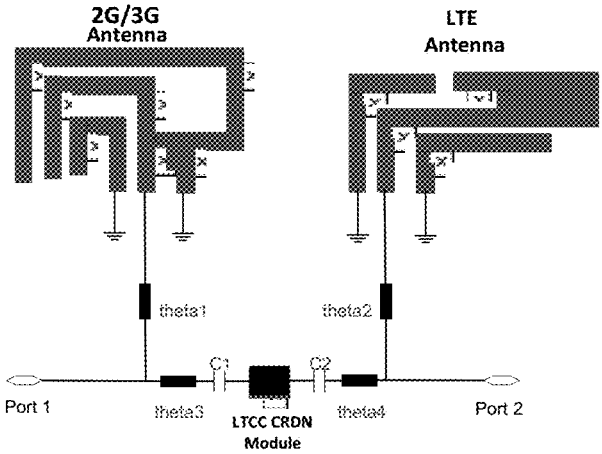

FIG. 6(*a*) illustrates a schematic circuitry diagram illustrating a decoupling scheme for two antennas operating in different frequency bands consistent with an embodiment of the present application. In this embodiment, the decoupling network is used for diminishing interferences between antennas for different wireless services. As shown, the example of this mobile phone is an LTE smart phone, in which a 2G/3G antenna and an LTE antenna are provided. As shown in FIG. 6(*a*), two different lumped element π networks are used for adjusting electrical length of the adjusting devices connecting with the antennas. The first lumped element π network is consisting of lumped capacitors C1 and C2 and a lumped inductance L1, while the second lumped element π network is consisting of lumped capacitors C3 and C4 and a lumped inductance L2.

In an embodiment, the decoupling network may be used for diminishing mutual couplings of two MIMO antennas working in the same frequency band in a mobile phone.

FIG. 6(*b*) illustrates a schematic circuitry diagram of a decoupling scheme with adjustable I/O coupling for two antennas operating in different frequency bands consistent with an embodiment of the present application. In this embodiment, the lumped capacitors C1 and C2 are used to adjust I/O coupling of the decoupling network, respectively, in order to realize different I/O couplings of the decoupling network, thus various levels of decoupling performance can be obtained.

In another embodiment, the decoupling network may be used for diminishing mutual couplings of adjustable I/O coupling for two antennas operating in the same frequency band. In this embodiment, the lumped capacitor C1 is used to adjust I/O coupling of the decoupling network in order to realize different I/O couplings of the decoupling network, thus various levels of decoupling performance can be obtained.

Figure 7:
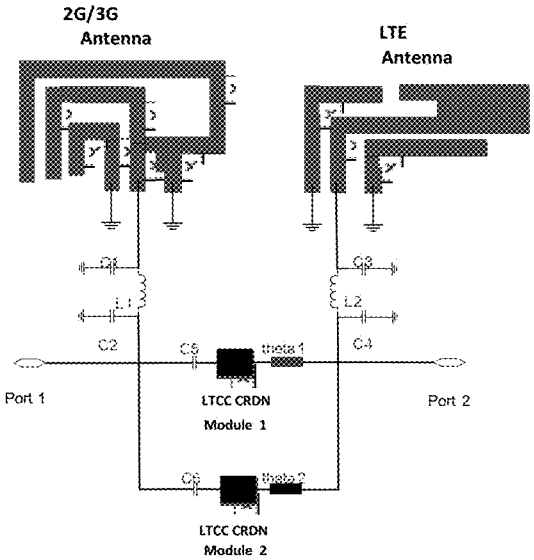
FIG. 7 is a schematic circuitry diagram illustrating a dual-band decoupling scheme for two antennas for different wireless services consistent with an embodiment of the present application.

FIG. 7 illustrates a schematic circuitry diagram illustrating a multi-band or a wide band decoupling scheme for two antennas for different wireless services consistent with an embodiment of the present application. In this embodiment, the decoupling network is used for diminishing interferences between antennas for different wireless services. As shown, the example of this mobile phone is an LTE smart phone, in which a 2G/3G antenna and an LTE antenna are provided. As shown in FIG. 7(*a*), two different lumped element π networks are used for adjusting electrical length of the adjusting devices connecting with the antennas. The first lumped element π network is consisting of lumped capacitors C1 and C2 and a lumped inductance L1, while the second lumped element π network is consisting of lumped capacitors C3 and C4 and a lumped inductance L2. Furthermore, the lumped capacitors C5 and C6 are used to adjust I/O coupling of the decoupling network, respectively, in order to realize different I/O couplings of the decoupling network.

Figure 8:
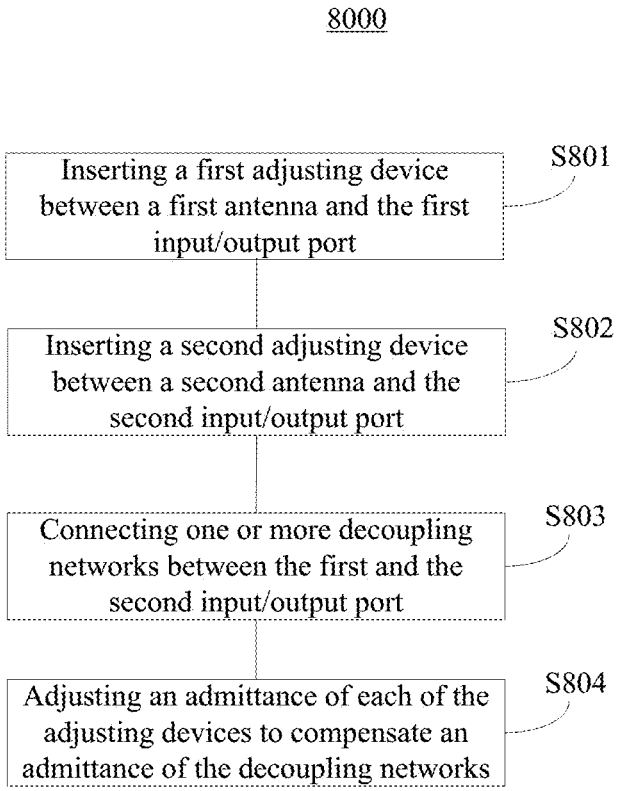
FIG. 8 is a flowchart illustrating a method for decoupling two antennas in a compact antenna array consistent with some disclosed embodiments.

FIG. 8 is a flowchart illustrating method 8000 for decoupling two antennas in an antenna array consistent with some disclosed embodiments. In an embodiment, the two antennas transmit and receive signals via a first input/output port 1 and a second input/output port 2. As discussed above, the antennas may operate in the same or different frequency bands. One end of the antenna 100 is connected to an input/output port 1 to transmit/receive data to/from the apparatus such as a mobile terminal in which the antenna array is installed. One end of the antenna is connected to an input/output port 2 to transmit/receive data to/from the apparatus in which the antenna array is installed.

At step S801, inserting a first adjusting device between a first antenna and the first input/output port 1 is proceeded. At step S802, inserting a second adjusting device between a second antenna of the two antennas and the second input/output port is proceeded. According to an embodiment, the first adjusting device and the second adjusting device may be configured to transmission lines. Alternatively, the first adjusting device and the second adjusting device may be configured to lumped element π networks.

At step S803, connecting one or more decoupling networks between the first input/output port and the second input/output port is proceeded. In an embodiment, the decoupling networks are connected between the first input/output port 1 and the second input/output port 2. As mentioned above, each of the decoupling networks may comprise a first I/O coupling module, a second I/O coupling module and a CRDN module.

According to an embodiment, the step S803 of connecting may further comprise: inserting the first I/O coupling module between the first input/output port and the CRDN module; inserting the second I/O coupling module between the first input/output port and the CRDN module; and adjusting electrical parameters of the first and second I/O coupling modules such that the decoupling networks have an adjustable working frequency and an adjustable decoupling level.

According to an embodiment, the first adjusting device and the second adjusting device may be made of distributed element circuits, such as a transmission line or stepped impedance resonators circuits. Alternatively, the first adjusting device and the second adjusting device may be made of any form of lumped element circuits, such as a single inductor, a single capacitor, an LC 'π' network, an LC 'L' network or combination of them.

According to an embodiment, the CRDN module may be composed of two or more resonators or resonant loops having at least one resonator, in which the resonator is configured to cooperate with the adjustable electrical length and characteristic impedance of each of the first and the second adjusting devices so as to isolate the two ports electrically.

The CRDN module may be implemented by using different passive integration technologies, including LTCC (Low Temperature Co-fired Ceramic) and multi-layered PCB. An illustrative example of a CRDN module in the form of a LTCC will be given hereinafter. In an embodiment, the CRDN module may be implemented by using lumped elements or distributed elements or mixture of both as long as desired isolation coefficient is obtained.

At step S804, adjusting an admittance of each of the first and the second adjusting devices to compensate an admittance of the decoupling networks such that an isolation coefficient between the two input/output ports approaches zero is proceeded. According to the embodiment, the first adjusting device and the second adjusting device are configured to have an electrical length and characteristic impedance, both of which are adjustable to compensate the admittance of the decoupling network.

According to another embodiment, the method 8000 may further comprise: connecting a controlling module to the first adjusting device and the second adjusting device, and the first I/O coupling module and the second I/O coupling module, and controlling the adjustment of the first adjusting device and the second adjusting device, and the adjustment of the first I/O coupling module and the second I/O coupling module so as to shift their working frequency bands, respectively.

According to another embodiment, the method 8000 may further comprise: adding a first matching network at one port of the two ports, adding a second matching network at the other port of the two ports, and adjusting the first matching network and the second matching network to broaden a matching bandwidth of the two antennas.

According to a further embodiment, the method 8000 may further comprise: connecting a plurality of the decoupling networks in parallel, each of the decoupling networks having different working frequency band such that decoupling of the antennas in multiple work frequency bands are achievable.

With the device for decoupling two antennas in a compact antenna array according to the present application, the proposed decoupling scheme can be applied to various antenna arrays. Taking the advantage of the LTCC multilayer technology, the device according to the present application can be made in a compact volume.

Furthermore, with the device according to the present application, good decoupling and matching conditions can be achieved over a wide frequency range. Besides, a tradeoff between decoupling bandwidths and levels of isolation can also be realized without reconfiguring the device.

Figure 9A:
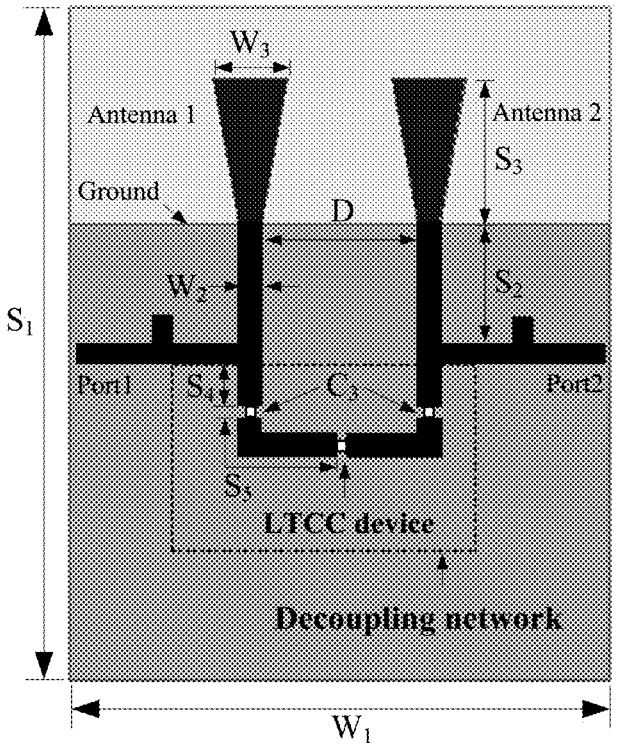
FIG. 9(*a*) is a schematic configuration diagram illustrating a testing antenna array with two antennas operating in the same frequency band consistent with some disclosed embodiments.
Figure 9B:
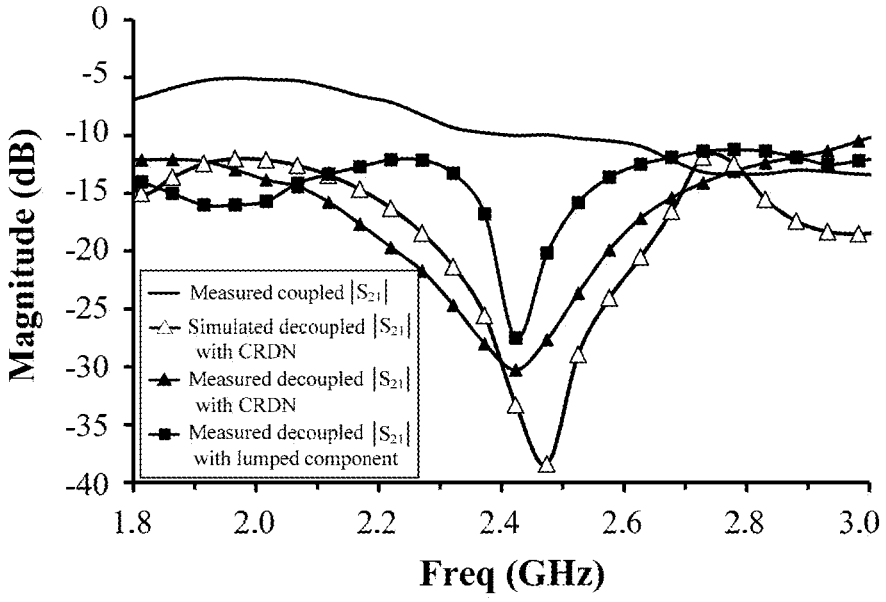
Figure 9C:
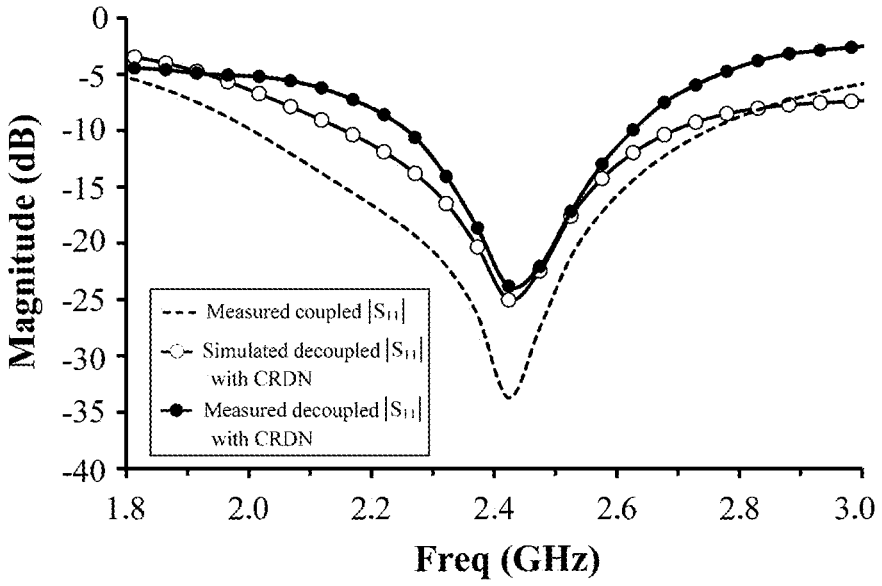
Figure 10A:
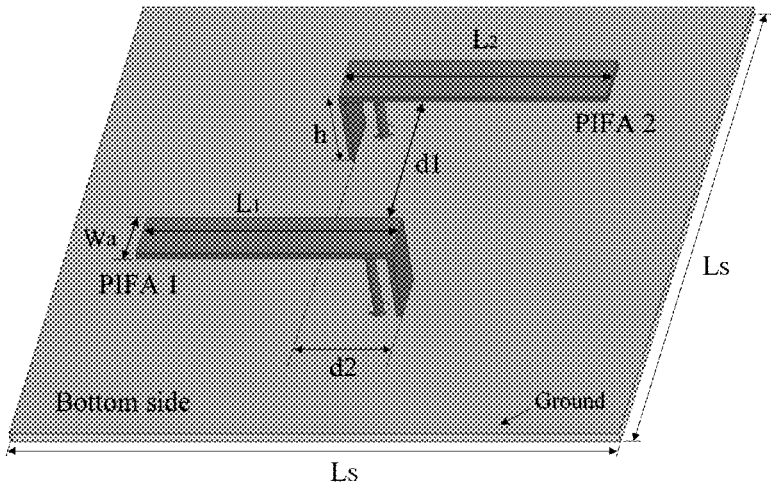
FIG. 10(*a*) is a schematic configuration diagram illustrating a testing antenna array with two antennas operating in the different frequency bands consistent with some disclosed embodiments.
Figure 10B:
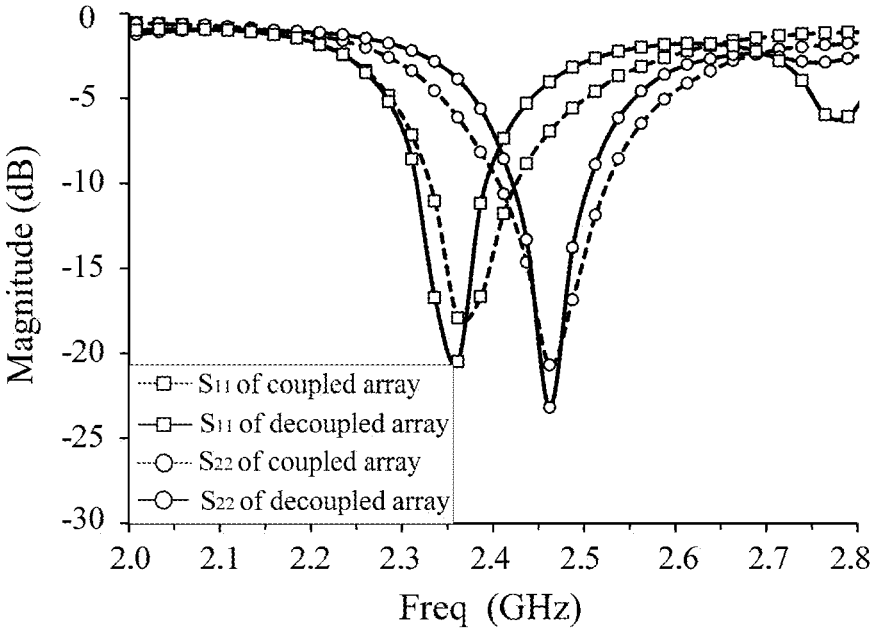
Figure 10C:
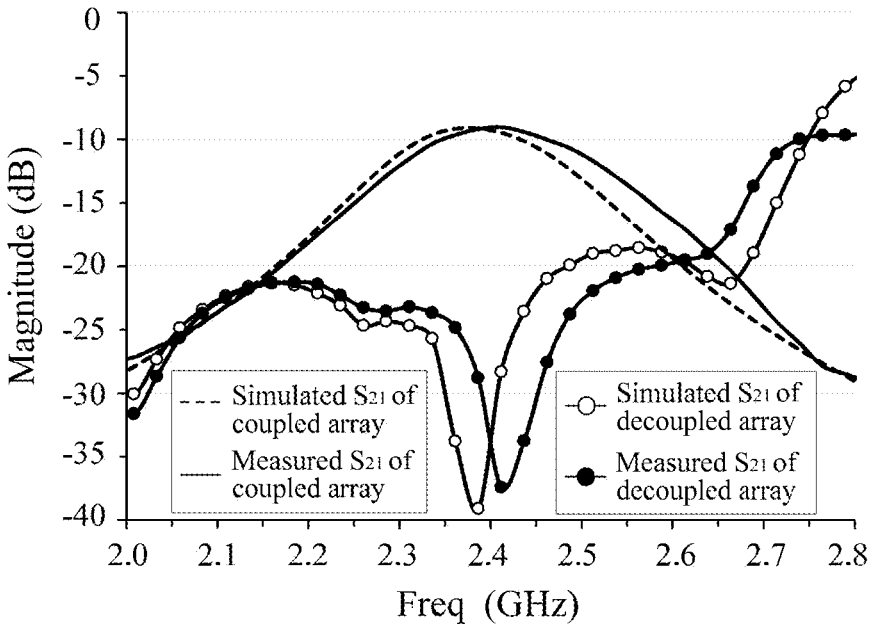
Figure 10D:
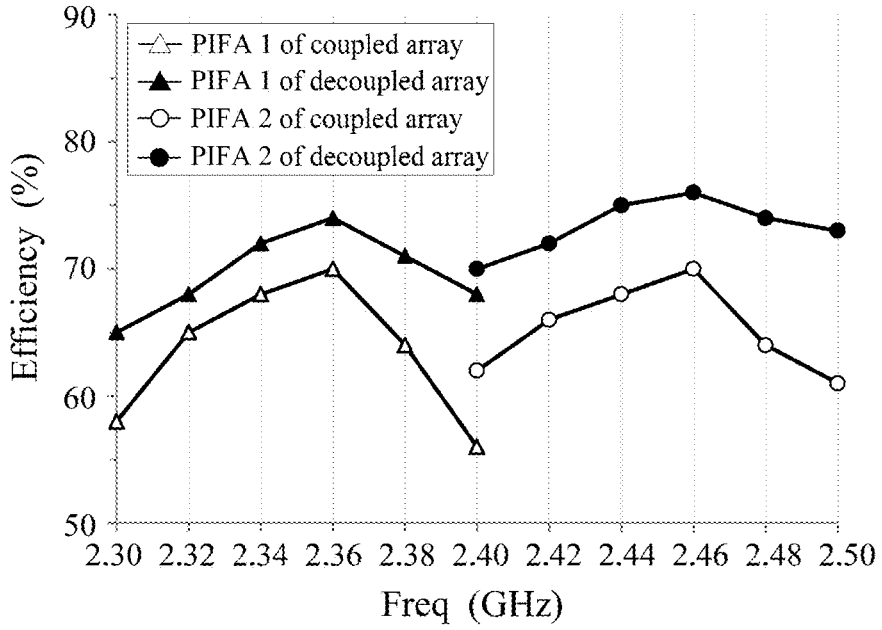

Such effects and advantages will be further verified with reference to the following experimental results shown in FIGS. 9(*a*)-9(*c*) and FIGS. 10(*a*)-10(*c*).

An example configuration of the entire apparatus, the detailed layout of the LTCC CRDN module together with the PCB board to be mounted is illustrated in FIG. 9(*a*). In the example embodiment, two coupled antennas working at 2.4 GHz band separated by distance D are printed on a FR4 board. The other antenna relevant dimensions are W2=3 mm, W3=9.8 mm and S3=19.4 mm. A section of transmission line of length S2 and characteristic impedance of Z0 is inserted at each antenna port.

FIG. 9(*b*) shows simulated and measured mutual coupling coefficient of the coupled and decoupled antennas arrays in the testing array of FIG. 9(*a*), and FIG. 9(*c*) shows simulated and measured reflection coefficient of the coupled and decoupled antennas arrays in the testing array of FIG. 9(*a*). It can be seen that the decoupling bandwidth with |S_21|≤−20 dB is about 14% (360 MHz), while the impedance matching bandwidth with |S_11|≤−10 dB is about 15% (370

MHz). For comparison, the same array decoupled by a lumped element has a decoupling bandwidth of about 3.7% for 20 dB isolation.

FIG. 10(*a*) shows an example configuration diagram illustrating a testing antenna array with two antennas operating in the different frequency bands according to another embodiment. In the embodiment, two antennas working at 2.35 GHz (TDD LTE band 40) and 2.45 GHz (ISM band) respectively and the corresponding LTCC decoupling network are given. It can be seen that the two antennas and the LTCC CRDN module, which are connected by two ports, are mounted on each side of a 60 mm×60 mm FR4 substrate. As shown in FIG. 10(*a*), the two antennas are coupled at a distance of d1=17 mm in the X-direction and d2=10 mm in the Y-direction, while the other antenna relevant dimensions are L1=26 mm, L2=25 mm, h=6.3 mm and Wa=5 mm.

FIGS. 10(*b*)-10(*c*) shows simulated and measured reflection and isolation coefficient of the coupled and decoupled antennas arrays in the testing array of FIG. 10(*a*). As shown, it is obvious that an improvement of at least 13 dB in isolation has been achieved after decoupling within the two contiguous frequency bands. Accordingly, the 6 dB matching bandwidths of the two antennas decrease from 180 MHz to 135 MHz (TDD LTE band 40) and 212 MHz to 150 MHz (ISM band), respectively. It is because for two coupled antennas, one acts as a lossy load for the other. Thus it is understandable that the matching bandwidth for a lossier antenna is wider. However, despite a slightly narrower matching bandwidth, the radiation efficiencies of the decoupled antennas are greater than those of coupled ones.

FIG. 10(*d*) presents the measured efficiencies of the two antennas before and after decoupling to further illustrate the merits of the proposed LTCC CRDN module. It can be seen that an obvious improvement in efficiency can be achieved when the proposed LTCC CRDN module is utilized, which could be very valuable for practical applications of mobile devices.

Therefore, with this antenna-independent LTCC CRDN module and appropriate adjusting devices and I/O coupling devices, a tradeoff between the decoupling bandwidth and level can be realized without reconfiguring the entire CRDN network. This attractive feature allows a mass production of one LTCC device for various applications as long as the frequency band is right.

The embodiments of the present invention may be implemented using certain hardware, software, or a combination thereof. In addition, the embodiments of the present invention may be adapted to a computer program product embodied on one or more computer readable storage media (comprising but not limited to disk storage, CD-ROM, optical memory and the like) containing computer program codes.

In the foregoing descriptions, various aspects, steps, or components are grouped together in a single embodiment for purposes of illustrations. The disclosure is not to be interpreted as requiring all of the disclosed variations for the claimed subject matter. The following claims are incorporated into this Description of the Exemplary Embodiments, with each claim standing on its own as a separate embodiment of the disclosure.

Moreover, it will be apparent to those skilled in the art from consideration of the specification and practice of the present disclosure that various modifications and variations can be made to the disclosed systems and methods without departing from the scope of the disclosure, as claimed. Thus, it is intended that the specification and examples be considered as exemplary only, with a true scope of the present disclosure being indicated by the following claims and their equivalents.

What is claimed is:

1. An apparatus for decoupling two antennas in an antenna array, wherein the two antennas transmit and receive signals via a first input/output port and a second input/output port of the apparatus, and the apparatus comprises:

a first adjusting device connected between a first antenna of the two antennas and the first input/output port;

a second adjusting device connected between a second antenna of the two antennas and the second input/output port; and one or more decoupling networks connected between the first input/output port and the second input/output port;

wherein the first adjusting device and the second adjusting device are configured to have an admittance adjustable to compensate an admittance of the decoupling networks such that an isolation coefficient between the two input/output ports approaches zero as well as reflection coefficients of each input/output port are minimized, wherein each of the decoupling networks comprise:

a Coupled Resonator Decoupling Network (CRDN) module;

a first I/O coupling module connected between the first input/output port and the CRDN module; and a second I/O coupling module connected between the second input/output port and the CRDN module;

wherein the first and second I/O coupling modules have adjustable electrical parameters such that the decoupling networks have an adjustable working frequency and an adjustable decoupling level.

2. An apparatus according to claim 1, wherein the first and the second adjusting devices are configured to have an electrical length and characteristic impedance, both of which are adjustable to compensate the admittance of the decoupling networks.

3. An apparatus according to claim 2, wherein the Coupled Resonator Decoupling Network (CRDN) module comprises at least two coupled resonators, wherein the at least two coupled resonators are configured to cooperate with the adjustable electrical length and characteristic impedance of each of the first and the second adjusting devices so as to isolate the two ports electrically.

4. An apparatus according to claim 1, further comprising a first matching network added at one input/output port of the two input/output ports and a second matching network added at the other input/output port of the two input/output ports, wherein the first matching network and the second matching network are configured to broaden a matching bandwidth of the two antennas.

5. An apparatus according to claim 1, wherein when there are plurality of the decoupling networks that connected in parallel, each of the decoupling networks having different working frequency band such that decoupling of the antennas at multiple frequency bands are achievable.

6. An apparatus according to claim 1, wherein the one or more decoupling networks are used for antennas operating in the same frequency band or antennas operating in different frequency bands.

7. An apparatus according to claim 1, further comprising a controlling module connected with the first adjusting device and the second adjusting device, and the first I/O coupling module and the second I/O coupling module, wherein the controlling module is configured to control the adjustment of the first adjusting device and the second adjusting device, and the adjustment of the first I/O coupling module and the second I/O coupling module so as to shift their working frequency bands, respectively.

8. An apparatus for decoupling a plurality of antennas in an antenna array, wherein the plurality of antennas transmit and receive signals via respective one of a plurality of input/output ports, the device comprises:

a plurality of adjusting devices, each of which connected between a respective antenna of the plurality of antennas and a respective one input/output port of the plurality of input/output ports; and one or more decoupling networks connected between the respective input/output ports of the plurality of input/output ports, wherein the plurality of adjusting devices are configured to have an admittance adjustable to compensate an admittance of the decoupling networks such that an isolation coefficient between the input/output ports approaches zero as well as reflection coefficients of each input/output port are minimized, wherein each of the decoupling networks comprise:

a Coupled Resonator Decoupling Network (CRDN) nodule;

a first I/O coupling module connected between the first input/output port and the CRDN module; and a second I/O coupling module connected between the second input/output port and the CRDN module;

wherein the first and second I/O coupling modules have adjustable electrical parameters such that the decoupling networks have an adjustable working frequency and an adjustable decoupling level.

9. A method for decoupling two antennas in an antenna array, wherein the two antennas transmit and receive signals via a first input/output port and a second input/output port, the method comprising:

inserting a first adjusting device between a first antenna of the two antennas and the first input/output port;

inserting a second adjusting device between a second antenna of the two antennas and the second input/output port;

connecting one or more decoupling networks between the first input/output port and the second input/output port; and adjusting an admittance of each of the first and the second adjusting devices to compensate an admittance of the decoupling networks such that an isolation coefficient between the two input/output ports approaches zero as well as reflection coefficients of each input/output port are minimized, wherein each of the decoupling networks comprises a Coupled Resonator Decoupling Network (CRDN), a first I/O coupling module and a second I/O coupling module, the method further comprises:

inserting the first I/O coupling module between the first input/output port and the CRDN module;

inserting the second I/O coupling module between the second input/output port and the CRDN module; and adjusting electrical parameters of the first and second I/O coupling modules such that the decoupling networks have an adjustable working frequency and an adjustable decoupling level.

10. A method according to claim 9, wherein the adjusting comprising:

adjusting an electrical length and a characteristic impedance of each of the first and the second adjusting devices to compensate the admittance of the decoupling networks.

11. A method according to claim 10, wherein the Coupled Resonator Decoupling Network (CRDN) comprises at least two coupled resonators, wherein the at least two coupled resonators are configured to cooperate with the adjusted electrical length and characteristic impedance of each of the first and the second adjusting devices so as to isolate the two ports electrically.

12. A method according to claim 9, further comprising:

adding a first matching network at one port of the two ports, adding a second matching network at the other port of the two ports, and adjusting the first matching network and the second matching network to broaden a matching bandwidth of the two antennas.

13. A method according to claim 9, further comprising:

connecting a plurality of the decoupling networks in parallel, each of the decoupling networks having different working frequency band such that decoupling of the antennas at multiple frequency bands are achievable.

14. A method according to claim 9, further comprising:

connecting a controlling module with the first adjusting device and the second adjusting device, and the first I/O coupling module and the second I/O coupling module, and controlling the adjustment of the first adjusting device and the second adjusting device, and the adjustment of the first I/O coupling module and the second I/O coupling module so as to shift their working frequency bands, respectively.

15. An apparatus for decoupling two antennas in an antenna array, wherein the two antennas transmit and receive signals via a first input/output port and a second input/output port of the apparatus, and the apparatus comprises:

a first adjusting device connected between a first antenna of the two antennas and the first input/output port;

a second adjusting device connected between a second antenna of the two antennas and the second input/output port; and one or more decoupling networks connected between the first input/output port and the second input/output port, each of which comprises:

a Coupled Resonator Decoupling Network (CRDN) module;

a first I/O coupling module connected between the first input/output port and the CRDN module; and a second I/O coupling module connected between the second input/output port and the CRDN module;

wherein, the first and second I/O coupling modules have adjustable electrical parameters such that the decoupling networks have an adjustable working frequency and an adjustable decoupling level, wherein the first and the second adjusting devices are configured to have an electrical length and characteristic impedance, both of which are adjustable to compensate the admittance of the decoupling networks, such that an isolation coefficient between the two input/output ports approaches zero as well as reflection coefficients of each input/output port are minimized.

* * * * *